United States Patent [19]

McCall et al.

[11] 4,049,270

[45] Sept. 20, 1977

[54] TETHERED BALL AND SHAFT GAME DEVICE

[76] Inventors: Adrian W. McCall, 80 Gaywood Place, Moraga, Calif. 94556; William L. Kellogg, 2912 Bayview Drive, Alameda, Calif. 94501

[21] Appl. No.: 679,154

[22] Filed: Apr. 22, 1976

[51] Int. Cl.[2] ..... A63B 67/00

[52] U.S. Cl. ..... 273/95 A; 273/58 C

[58] Field of Search ..... 273/95 A, 58 C, 26 E, 273/29 A; 46/51, 52

[56] References Cited

U.S. PATENT DOCUMENTS

| | | | |
|---|---|---|---|
| 1,538,720 | 5/1925 | Mercer | 273/95 A |
| 2,839,300 | 7/1958 | Blaha et al. | 273/26 E |
| 3,104,877 | 9/1963 | Gross | 273/95 A |
| 3,494,618 | 2/1970 | Kramer | 273/95 R |
| 3,508,359 | 4/1970 | Jernstrom et al. | 273/95 R |

FOREIGN PATENT DOCUMENTS

| | | | |
|---|---|---|---|
| 408,160 | 1934 | United Kingdom | 273/29 A |

*Primary Examiner*—Richard C. Pinkham
*Assistant Examiner*—Lawrence E. Anderson
*Attorney, Agent, or Firm*—Bielen and Peterson

[57] ABSTRACT

A game device providing exercise and recreation preferably for two players, which comprises a staff with a ball connected to the mid portion of the staff by a line having an adjustable length, the staff having end pads affixed to each end of the staff enabling the ends to be positioned against the bodies of two players such that the staff is horizontally oriented, the players oscillating in unison to wind and unwind the ball and line on the staff.

4 Claims, 8 Drawing Figures

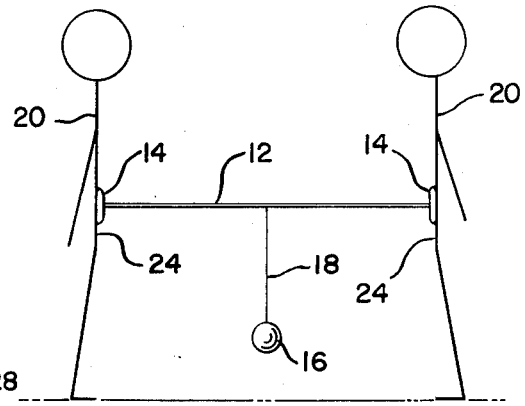
FIG. 1
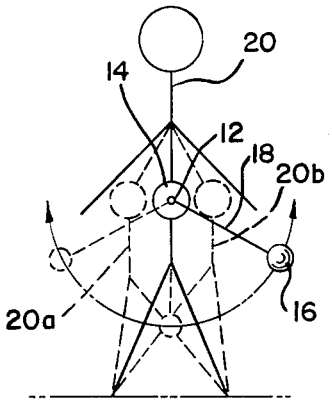
FIG. 2
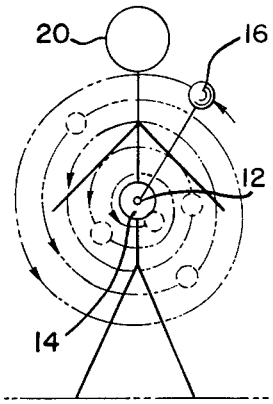
FIG. 3
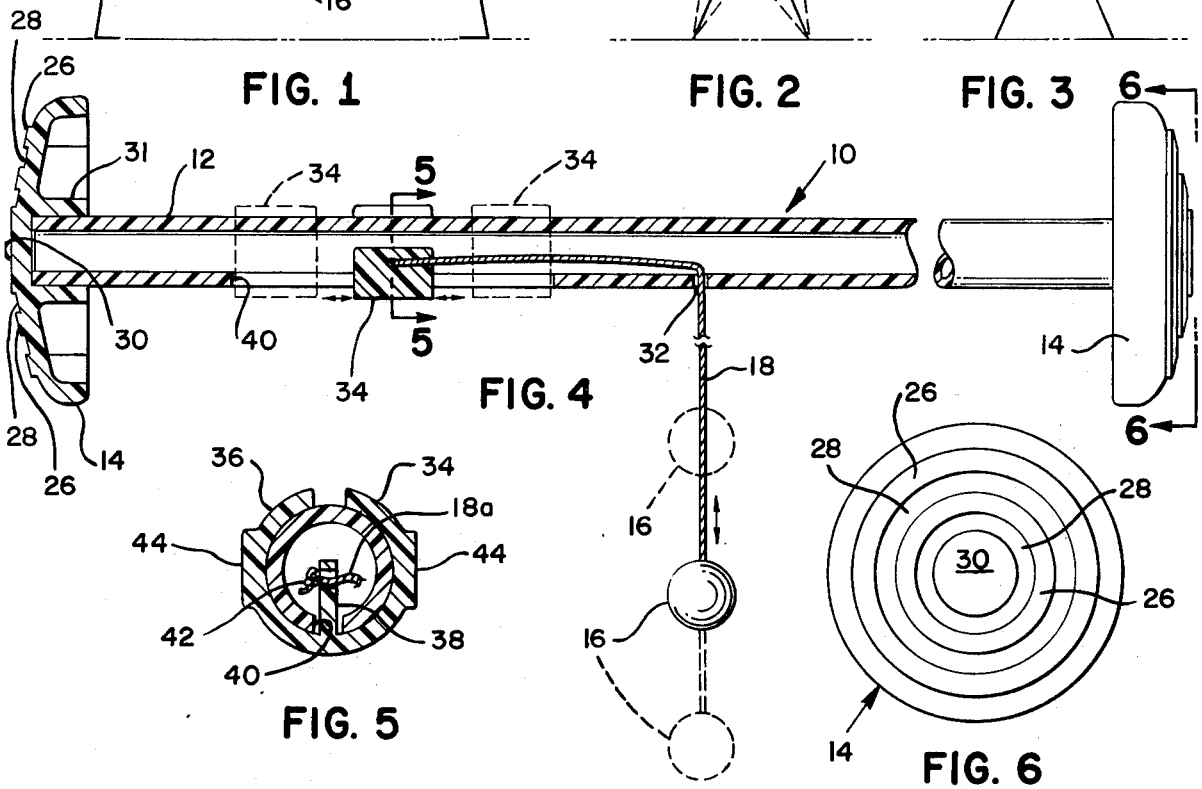
FIG. 4
FIG. 5
FIG. 6
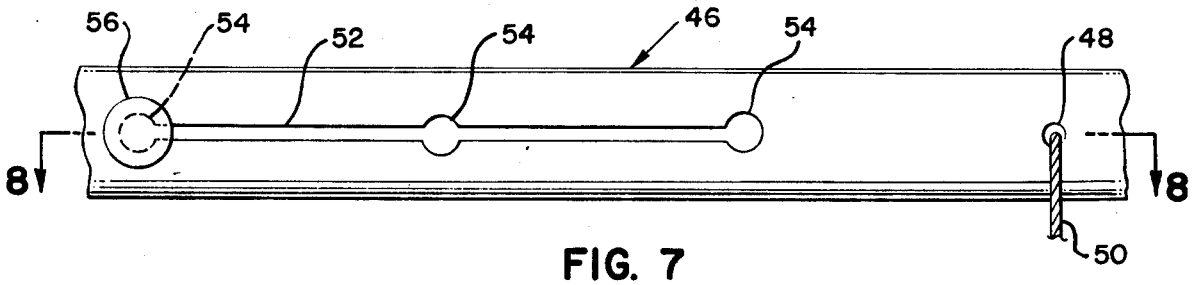
FIG. 7
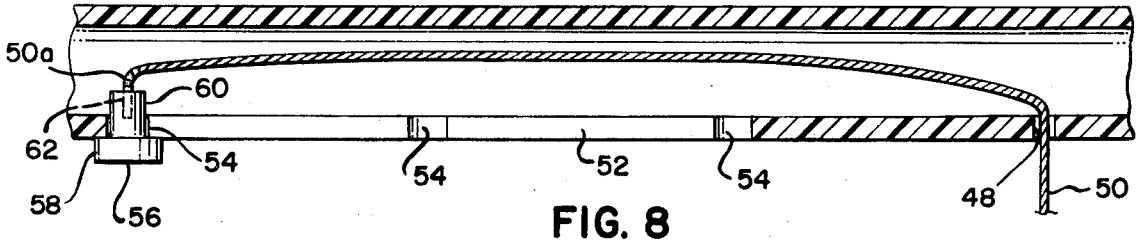
FIG. 8

TETHERED BALL AND SHAFT GAME DEVICE

BACKGROUND OF THE INVENTION

This invention relates to the class of amusement devices and toys and in particular to a spinning and whirling device. The game device of this invention comprises a device that not only provides for the recreation, entertainment and amusement of the users, but also importantly provides for exercise and coordination development that is beneficial to the health of the users. In the past, certain game devices have been devised which couple both amusement and a combination of coordination and exercise. The paddle ball, and most notably the hulla hoop have been extremely popular examples of such devices. The device of this invention combines the coordination of the hulla hoop and the skill of the paddle ball. Further, this device has the advantage that it is preferably operated by two people which multiplies the enjoyment of the device.

SUMMARY OF THE INVENTION

The game device of this invention comprises a staff having two horizontally end pads enabling the staff to be horizontally supported between two persons by pressure on the padded ends of the staff by the bodies of the players. A ball is suspended from a length of line or cord attached approximately at the center of the staff. The object is for the two players to cooperate in getting the ball and line to wrap around the staff in a winding and unwinding sequence. The difficulty can be varied by varying the length of the line by an integral adjustment means in the staff.

The ball and staff game device is basically used in the following manner. Two participants face one another about three or four feet apart, each with feet slightly spread apart for balance. A light weight staff having end pads is positioned horizontally between the two players with the end pads against the midriff of each player such that the staff is supported by the pressure of the players against the ends of the staff. A soft, rubber ball suspended from a line at the center of the staff is induced into a pendulum motion by the unison swaying of the participants without the use of their hands. The tempo of the swaying is increased by the participants until the pendulum or swinging motion of the ball travels completely around and wraps all of the line around the staff. By reversing the procedure, the ball can be unwound from the staff in the opposite direction or rotation. By determining the time required to perform a single wrap or a series of wraps and unwraps the game can take on a competitive nature. This adds to the excitement because the speed of accomplishment is still dependent on a cooperative effort, which is often difficult to maintain under the intensity of competition.

As the participants become proficient, the pads may be placed against other parts of the body such as shoulders, buttocks, legs, etc., to alter and intensify the competition.

Varying the length of line between the staff and the ball allows for compensation for different heights of individuals, for example, children and adults, and alters the degree of difficulty, a longer line being more difficult to wrap than a shorter one. To provide for variance in the line, an anchor key attached to the end of the ball line is slidably arranged in a slot in a hollow staff to draw in or let out a length of line through an aperture in the staff. In this manner, the length of line can be easily and quickly adjusted. Naturally, the length of line should not be so long as to allow the ball to touch the ground during normal use.

These and other features of the ball and staff game device will become apparent on consideration of the detailed description of the preferred embodiments hereafter.

BRIEF DESCRIPTION OF THE DRAWINGS

FIG. 1 is a schematic side view of the ball and staff device and manner of use.

FIG. 2 is a schematic end view of the ball and staff device and manner of initiating rotation of the ball around the staff.

FIG. 3 is a schematic end view of the ball and staff device with rotation of the ball around the staff initiated.

FIG. 4 is a side elevatinal view, partially in section of the ball and staff device.

FIG. 5 is a cross sectional view taken on the lines 5—5 in FIG. 4.

FIG. 6 is an end view taken on the lines 6—6 in FIG. 4.

FIG. 7 is an enlarged fragmentary view of an alternate staff embodiment.

FIG. 8 is a cross sectional view taken on the lines in FIG. 7.

DETAILED DESCRIPTION OF THE PREFERRED EMBODIMENTS

Schematic illustrations of the basic ball and staff device, designated generally by the reference numeral 10, are shown in FIGS. 1–3. In FIG. 1, a staff 12, having two identical end pads 14 and a ball 16 suspended from a line 18 is shown positioned between two participants 20. The staff 12, positioned horizontally between the two participants, 20 is maintained by pressure exerted by the midriff 24 of the participants against the end pads 14.

The object of the arrangement is to wind and unwind the ball 16 around the staff 12 as quickly as possible. To begin the winding the participants 20 must sway back and forth, as schematically illustrated in dotted line by the positions **20*a* and 20*b* of the participant shown in FIG. 2. The ball 16 suspended from the line 18 begins a pendulum motion oscillating from one position shown in prime line to an opposite position shown in dotted line. Eventually with proper coordination the ball 16 is able to circumvent the staff 12 as shown in FIG. 3.** Gradually, as depicted by the spiral path shown in phantom, the ball is wound up to the stick where the motion can be reversed.

The preferred construction of the ball and stick device 10 is shown in FIG. 4. Referring to FIG. 4, the staff 12 is shown with hollow tube construction, approximately 3 feet in length. The staff is preferably fabricated from a relatively rigid plastic material, but may be fabricated from other materials such as aluminum. Affixed at each end of the staff 12 are the pads 14 which are fabricated from a solid moulded plastic for safety and durability. The end pads 14 are circular, as shown in FIG. 6, and approximately four inches in diameter. The surface of the pads 14 is curved and includes two concentric raised rings 26 spaced by two concentric depressed rings 28 around a circular center area 30. This design allows the pads to be comfortable and slip resistant when supported against a participants clothing or bare skin surfaces. The curvature of the end pads across the concentric rings 26 and 28, from the flat center area 30 is optimized at approximately 12 degrees from the flat of the center area 30. The end pads 14 include an inside hub 31 into which each end of the staff is inserted and preferably fastened.

Referring to FIG. 4, the ball 16 is shown attached to the line 18 suspended from the staff 14. The ball is preferably sponge rubber and is approximately two inches in diameter with a smooth, shiny surface treated with a plastic coating of a bright color. The line 18 comprises a twine of durable material such as nylon and is of a fixed length approximately three feet in length. The line 18 is attached at one end to the ball 16, suspended through an aperture 32 in the staff 12 and attached at its other end to an adjustment key 34.

As shown in FIGS. 4 and 5, the adjustment key 34 comprises a broken sleeve body 36 and a centrally positioned integral tang 38 which is inserted in a longitudinal slot 40 in the staff 12. The broken sleeve body 36 of the slide is constructed to provide a clamping action against the staff 12. In this manner, the adjustment key 34 is slidable on the staff when manipulated, but remains in position when adjusted, thereby providing an anchor for the end 18a of the line 18. The end 18a of the line 18 passes through the aperture 32 along the inside of the staff and is fastened by a knot 42 to the tang 38. Movement of the adjustment key alters the effective length of the suspended line between the aperture 32 in the staff 12 and the ball 16. Whenever it is desired to change the length of the line, for example to vary the difficulty or adjust for height of the participants, the adjustment key can be simply grasped by its side grips 44 and moved to effect the desired length.

An alternate embodiment of the adjustment key is shown in FIGS. 7 and 8 to demonstrate the various alternate means which may be used to provide for adjustment of the line. In FIG. 8 a staff 46 is shown with a small aperture 48 through which a line 50 connected to a ball (not shown) is suspended. The tubular staff 46 includes a longitudinal slot 52 with a series of three enlarged circular holes 54 along the length of the slot 52 into which is inserted a stop key 56.

The stop key 56 has an enlarged head 58 and an elongated neck 60 which is selectively insertable in a selected hole in the manner of a plug. The end **50*a* of the line 50 is fixed in a hole 62 at the end of the neck 60 by gluing. Other means such as crimping or pressure clamping may be employed as desired to insure that the line is anchored to the stop key 56**.

By withdrawing the stop key 56 and inserting it into a desired hole 54, the effective length of the line can be changed. The elongated slot 52 communicating with the series of holes 52 allows the line to pass with the stop key from one hole to another. In this manner, the effective length of line extending from the aperture 48 can be incrementally adjusted to a variety of positions depending on the number of adjustment holes placed along the slot. In other respects the alternate embodiment shown in FIGS. 7 and 8 is the same as the embodiment shown in FIG. 4.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A ball and staff game device comprising: an elongated staff with distally spaced opposite ends; a pair of enlarged end pads connected to the opposite ends of the staff for horizontal support of the staff; a line of predetermined length having first and second ends; a ball, wherein the first end of the line is connected to said ball and the second end of the line is connected to said staff, said line having a substantial segment pendant from the staff approximately midpoint along the staff; and, a line adjustment means connected to said second end of the line for adjusting the length of the segment of line pendant from the staff, wherein said adjustment means comprises an adjustable slide mechanism slidably engaged with said staff said slide mechanism having a plurality of positions on said staff to which it is movable, said slide mechanism having clamping means for maintaining said slide mechanism at the position to which it is moved, said second end of said line being connected to said slide mechanism, wherein said staff comprises a hollow tube, said tube having a longitudinal slot along a portion of said staff and an aperture proximately displaced from said slot, and wherein said slide mechanism includes a tang insertable in said slot, said line being connected to said tang and passed through said hollow tube and out said aperture.

2. A ball and staff game device comprising: an elongated staff with distally spaced opposite ends; a pair of enlarged end pads connected to the opposite ends of the staff for horizontal support of the staff; a line of predetermined length having first and second ends; a ball, wherein the first end of the line is connected to said ball and the second end of the line is connected to said staff, said line having a substantial segment pendant from the staff approximately midpoint along the staff; and, a line adjustment means connected to said second end of the line for adjusting the length of the segment of line pendant from the staff, wherein said adjustment means comprises a key stop mechanism engageable in a plurality of discrete stop positions on said staff, said second end of said line being connected to said stop mechanism.

3. The game device of claim 2 wherein said staff comprises a hollow tube, said tube having a longitudinal slot along a portion of said staff and an aperture proximately displaced from said slot, said slot having a plurality of discrete enlarged apertures into which said stop mechanism is selectively engageable, and wherein said second end of said line is connected to said stop mechanism, said line being passed through said hollow tube and out said aperture.

4. A ball and staff game device comprising: an elongated staff with distally spaced opposite ends; a pair of enlarged end pads connected to the opposite ends of the staff for horizontal support of the staff; a line of predetermined length having first and second ends; a ball, wherein the first end of the line is connected to said ball and the second end of the line is connected to said staff, said line having a substantial segment pendant from the staff approximately midpoint along the staff; and, a line adjustment means connected to said second end of the line for adjusting the length of the segment of line pendant from the staff, wherein said staff comprises a hollow tube, said tube having a longitudinal slot along a portion of said staff and an aperture proximately displaced from said slot, and wherein said line adjustment means includes a stop mechanism engageable with said slot and moveable with respect to said slot to a plurality of positions on said slot said line being connected to said stop mechanism and passed through said hollow tube and out said aperture.

* * * * *